US005522573A

United States Patent [19]

Xiao

[11] Patent Number: 5,522,573

[45] Date of Patent: Jun. 4, 1996

[54] ARM BRACE

[76] Inventor: Ji Xiao, 2612 Van Patten St. Apt. 10, Las Vegas, Nev. 89109

[21] Appl. No.: 273,124

[22] Filed: Jul. 14, 1994

[51] Int. Cl.[6] ..... A45F 5/00

[52] U.S. Cl. ..... 248/118; 224/267

[58] Field of Search ..... 248/118, 118.3, 248/118.5, 351, 118.1; 42/94; 224/101, 222, 267

[56] References Cited

U.S. PATENT DOCUMENTS

| | | | |
|---|---|---|---|
| 46,365 | 2/1865 | Kinman . | |
| 281,333 | 7/1883 | Butler . | |
| 2,172,178 | 9/1939 | Rosenberg . | |
| 2,707,071 | 4/1955 | Adams | 248/118 X |
| 3,200,528 | 8/1965 | Christensen | 42/94 |
| 3,390,477 | 7/1968 | Galbraith . | |
| 4,211,219 | 7/1980 | Alvey . | |
| 4,674,472 | 6/1987 | Reis | 248/118 X |
| 4,844,390 | 7/1989 | Duke . | |
| 5,111,983 | 5/1992 | Simmons et al. . | |
| 5,351,867 | 10/1994 | Vest | 42/94 X |

*Primary Examiner*—Alvin C. Chin-Shue
*Assistant Examiner*—Derek J. Berger
*Attorney, Agent, or Firm*—Richard C. Litman

[57] ABSTRACT

An arm brace, when positioned in the underarm intermediate a user's upper arm and lateral part of the user's thorax, assists in the carrying of heavy objects at shoulder level. The arm brace includes a lightweight wedge having two body contoured surfaces, one for receiving the upper arm, and another for the thorax. These two surfaces meet at an acute angle. An open structural framework is employed to reduce the weight of the wedge. This can take the form of the two surfaces and a horizontal buttress. The wedge may be made collapsible through a hinged connection between the surfaces, and between one of the surfaces and the buttress. The brace engages the upper arm through a strap attached to the upper arm receiving surface. The arm brace allows a user to carry heavy loads without fatigue, discomfort, and with reduced risk of injury.

7 Claims, 7 Drawing Sheets

ARM BRACE

BACKGROUND OF THE INVENTION

1. Field of the Invention

The present invention relates to an arm brace. More particularly, the present invention relates to a support brace which steadies the arm and redistributes forces on the arm to the upper torso.

2. Description of the Prior Art

Various braces are known which restrict the relative position of the upper arm and the torso of an individual. U.S. Pat. No. 281,338 to Butler discloses an arm rest which includes a flexible arm band attached to an arm support member, a vertical torso support member hingedly attached to the arm support member, and an adjustable prop which allows the arm support member to be held at various angles with respect to the torso support member. Both the arm and torso support members are secured to their respective body parts with belts.

Similarly, U.S. Pat. No. 46,365 to Kinman discloses an arm supporter which includes an adjustable arm support element hingedly and pivotally connected to body support element. The body support element includes a rigid U-shaped brace which is secured to a rifleman's waste with a belt.

To assist in aiming a gun, U.S. Pat. No. 3,390,477 to Galbraith discloses an upper arm brace with a contoured arm rest. This brace is supported on a hip through an adjustable bifurcated rod to a belt mounted plate. U.S. Pat. No. 4,844,390 to Duke discloses another belt supported arm brace which is retractable, and pivots to hang from the waist when not in use.

A support device for cameramen that includes a brace member for both the thigh and upper arm is disclosed by U.S. Pat. No. 5,111,983 to Simmons et al. This device is secured to both the waist and upper body through belts and straps. A similar device, but without the belts or straps is disclosed by U.S. Pat. No. 2,172,178 to Rosenberg.

A body brace which is useful in preventing injury to a person lifting or carrying weights is disclosed by U.S. Pat. No. 4,211,219 to Alvey. Though this triangular device may be strapped to the arm, weight is distributed from the elbow to the pelvis, not the humerus to the upper torso or thorax. Further, the body engaging sides of the triangle are normal to each other, rather than acutely angled.

None of the above inventions and patents, taken either singly or in combination, is seen to describe the instant invention as claimed.

SUMMARY OF THE INVENTION

In numerous occupational as well as recreational endeavors, heavy objects need to be carried by hand in a relatively stable manner. One well established method is to hoist the object onto or about one's shoulder and squeeze the upper arm against the lateral thorax area of one's torso. When this method is employed repeatedly and/or for extended periods of time, various muscular and skeletal problems may develop and/or be aggravated. These problems arise from a combination of the weight carried, the distribution of that weight, and the contortions required to bear the weight.

The present invention provides an arm brace which, positioned in the underarm intermediate a user's upper arm and lateral part of the user's thorax, assists in carrying heavy objects at shoulder level which greatly reduces the problems arising from conventional unassisted methods. The arm brace includes a lightweight wedge having two body contoured surfaces, one for receiving the upper arm, and another for the thorax. The two body contoured surfaces form an acute angle of the wedge. The wedge engages the upper arm through a strap attached to the upper arm receiving surface.

To keep the weight of the present device to a minimum, an open structural framework for the wedge is employed. The two contoured surfaces may of unitary construction, in a generally V-shaped configuration, or attached in such a way that the angle between them is constant when in use. To this end, a buttress or buttresses may be employed between the two surfaces, as part of a unitary wedge element, fixedly attached to both surfaces, secured by stops in both surfaces, or a combination of the above.

The present invention may also be made collapsible to reduce its bulk when not in use. Hinges may be provided at the point where the arm engaging surface meets the torso engaging surface, where one or both of the surfaces meets a buttress or buttresses, and within the buttress itself. It is important when such a hinged construction is employed that the device is provided with a mechanism to lock the device for use at the above mentioned acute angle. Optionally, mechanisms may be employed to secure the device in the collapsed state.

The present invention, in both the collapsible and rigid embodiments, move to an unobtrusive position when not in use. This naturally occurs when the arm is rotated from a lifting position to a rest position.

Accordingly, it is a principal object of the invention to provide a structural support for an individual to carry heavy objects at substantially shoulder height, which allows the user to maintain a substantially upright posture without fatigue, discomfort, and with reduced risk of injury.

Another object of the invention to provide a device in which the support is positioned in the underarm when the arm is bent with the forearm extending upwards, and to the rear when the arm is at rest.

Still another object of the invention is to distribute a significant portion of the weight of heavy objects from an upward load bearing arm of an individual to a lateral force onto the individual's thorax.

It is a further object of the invention to provide a support which may be collapsible into a more compact form to facilitate storage and/or to reduce bulk when not in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following description and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
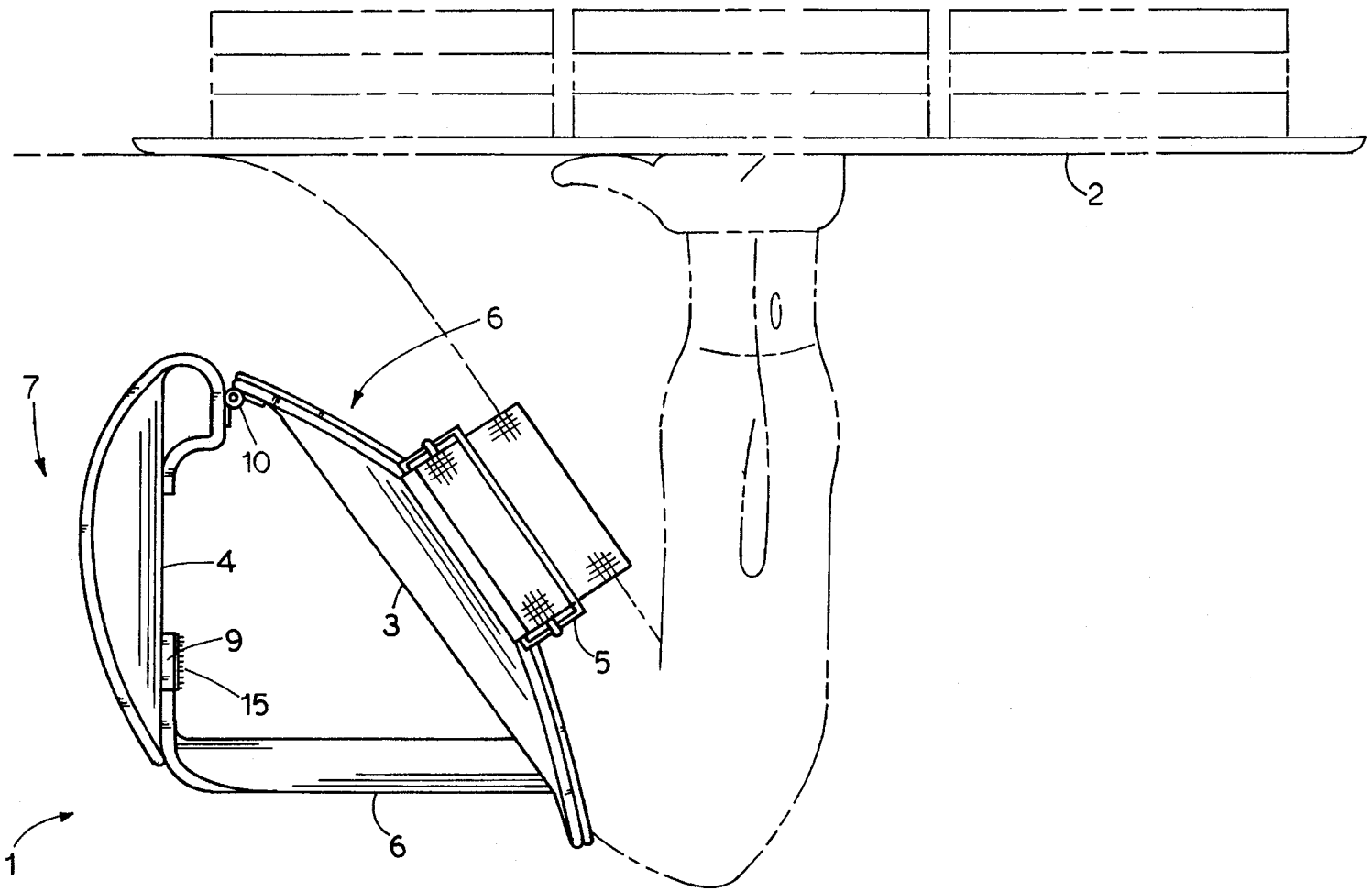
FIG. 1 is an environmental view of a preferred embodiment of the present invention, positioned for use.

With reference to FIG. 1 of the drawings, the present invention includes a support member 1, facilitating the carrying of a tray 2 or the like upon or over a user's shoulder. The support member includes a wedge element having a first section 3, and a second section 4, each provided with a body-engaging outer surface. A retention element 5 is attached to the first section of the wedge element and engages the humerus area 6 of a user's upper arm to maintain the outer surface of said first section juxtaposed upon the humerus area of the user's upper arm while allowing arcuate displacement thereabout.

With the wedge element disposed intermediate a user's upper arm and lateral part of the user's thorax 7, the user's upper arm is firmly supported by said wedge element and maintained in an outward oblique disposition such that the user's forearm may in turn be maintained in a substantially upward direction to facilitate carrying of items substantially at or above the user's shoulder level as downward fores applied to the user's arm are laterally vectored to the user's thorax by the wedge member.

When in use, the wedge element substantially defines a predetermined fixed acute angle between the humerus receiving first section 3 and the vertical thorax contacting second section 4. This may be accomplished with a rigid brace, wherein the first and second sections are permanently attached or unitarily formed at an acute angle of between about 20 to 50 degrees. To provide further strength, the wedge element preferably has a horizontal buttress 8 between the first and second sections.

The horizontal buttress may be fixedly attached to the lower ends of the first and second sections of the wedge element to form a substantially rigid support structure. Accordingly, in one preferred embodiment of the present invention, a substantially rigid framework is defined by the first section, the second section, and the horizontal buttress; which may be fixedly attached together through any appropriate fastener, or be of unitary construction.

Figure 3:
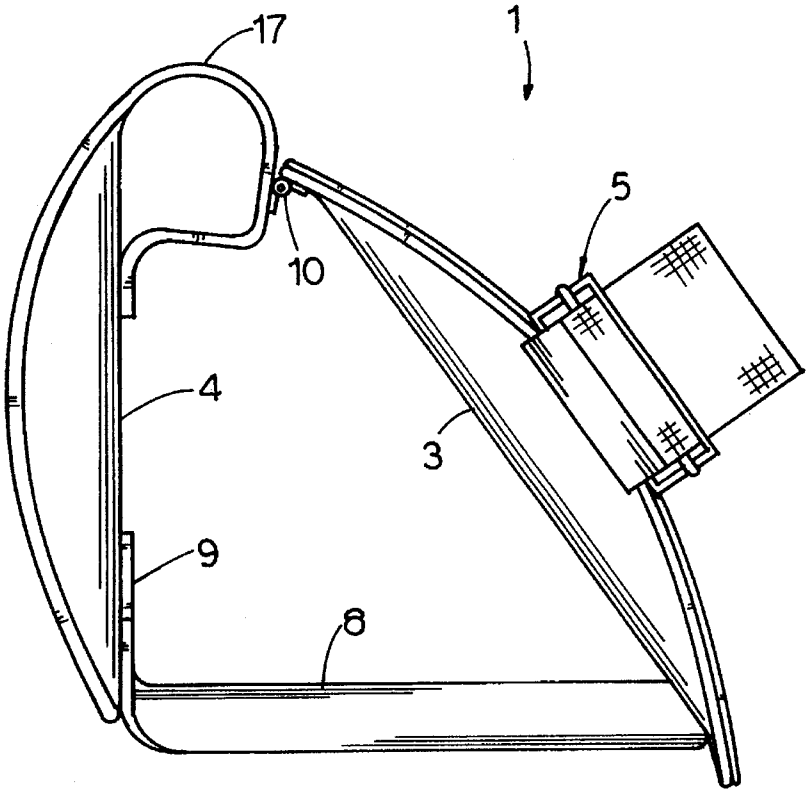
FIG. 3 is a side view of the same, in a locked rigid form.
Figure 2:
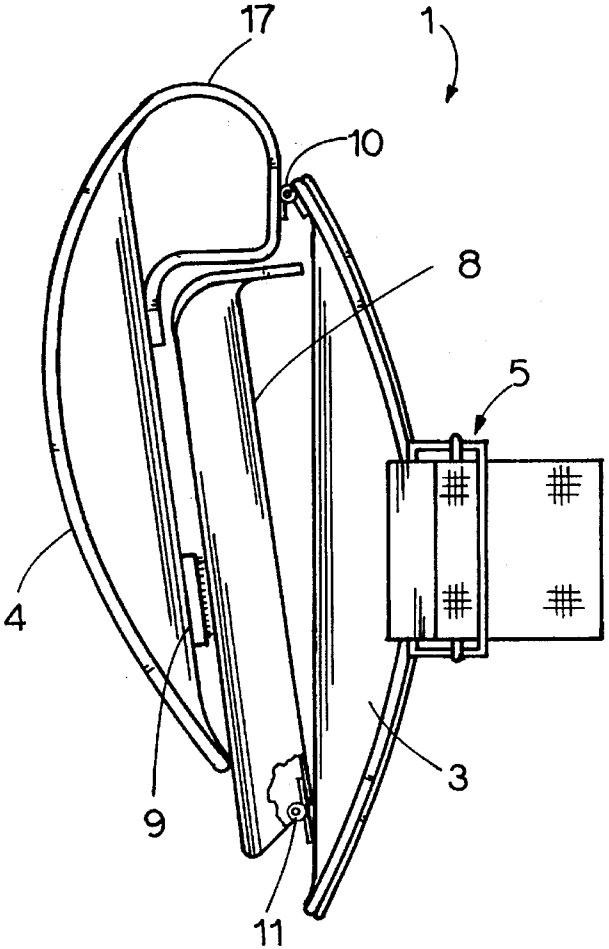
FIG. 2 is a side view of the an embodiment of the present invention in a folded form.

Alternatively, the first section and second section of the wedge element 1 are hingedly attached to provide a collapsible open framework. In this preferred embodiment, as shown in FIGS. 2 and 3, a hingedly attached brace, or buttress, allows the support member to be easily folded from an open position, FIG. 3, to a closed position, FIG. 2.

A hinge 10 is preferably deployed on an out-jutting extension 17 of second section 4, attaching the second section to the topmost part of first section 3. A second hinge 11 is deployed on one end of buttress 8 attached to the first section distal from hinge be. A stop 9 secures this embodiment of the present invention in the open position, ready for use. Accordingly, sufficient resilience is provided by the first section, the second section, the hinges, or combination thereof to allow the buttress to be raised over the stop in collapsing the support member. It should be appreciated that in this arrangement, the structural framework will remain rigid under use conditions, where the buttress 8 is firmly pressed against the second section 4.

Figure 4:
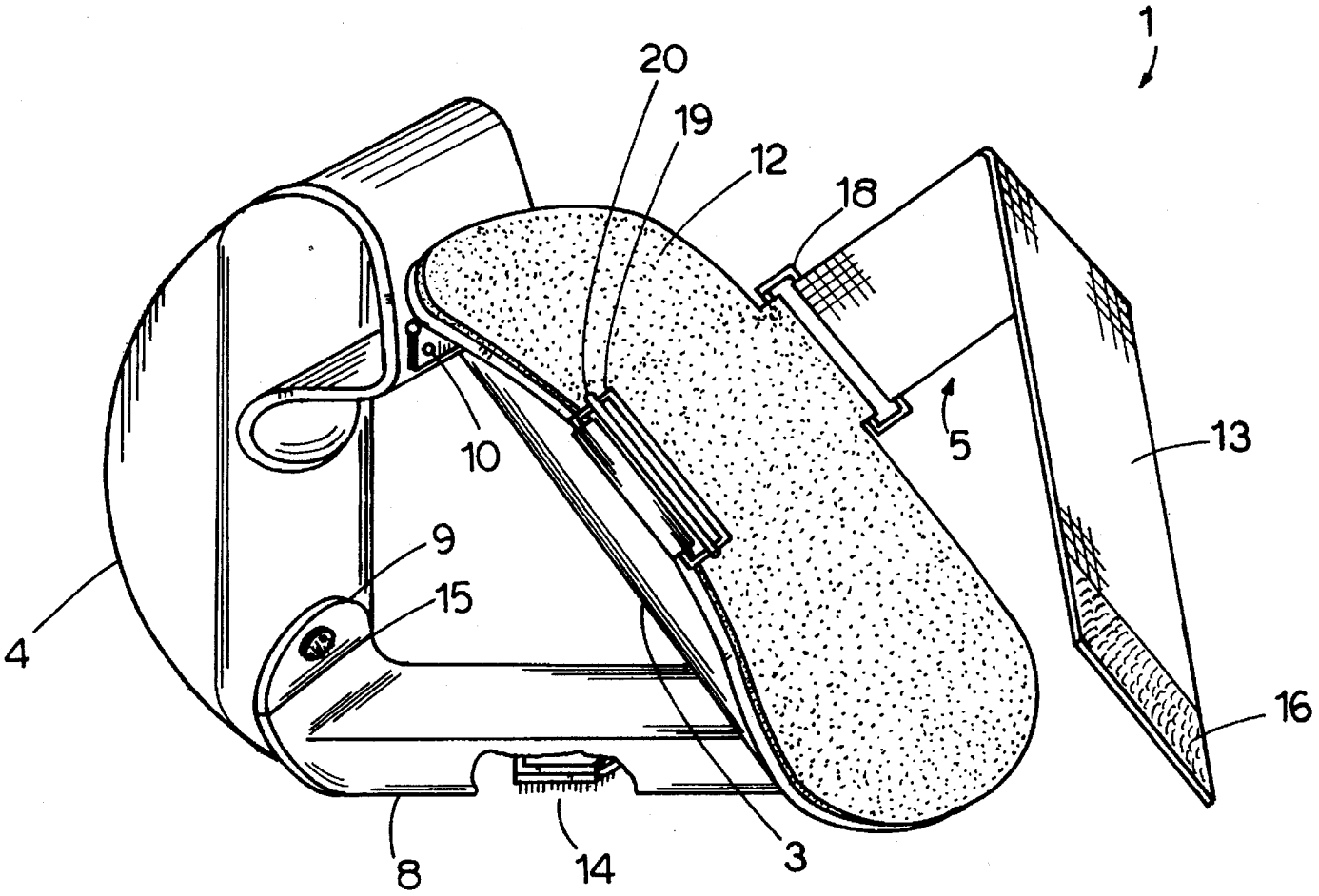
FIG. 4 is a perspective view of an embodiment of the present invention.
Figure 5:
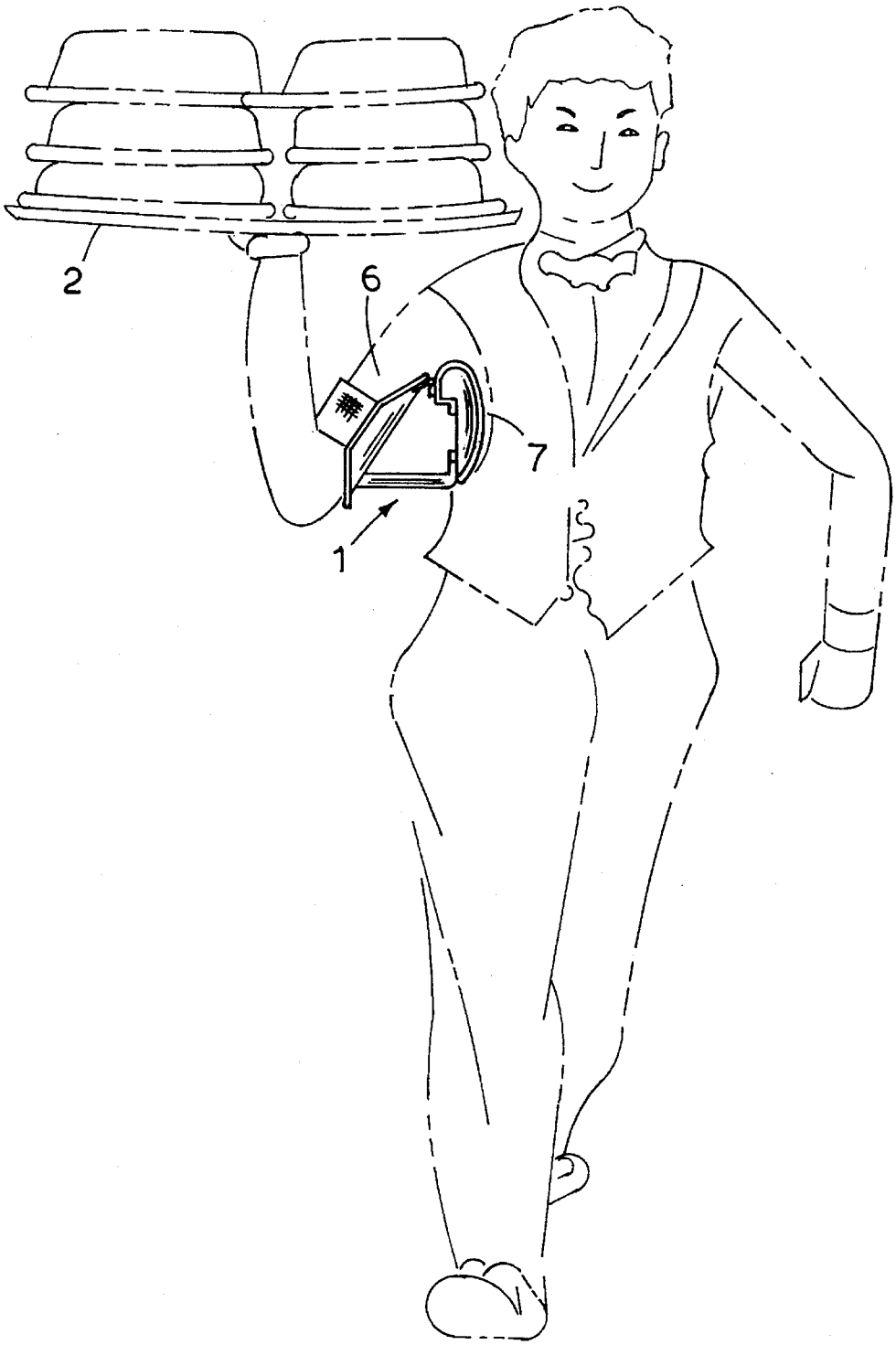
FIG. 5 is an environmental view of the present invention in use by an individual carrying a loaded tray.

Fastening mechanisms may be provided to secure the arm brace in its folded state. Preferably, opposed members of a reversible attachment system, such as magnet/metal, hooks/loops (e.g., VELCRO™), snaps, and latches are used. Most preferably, as seen in FIG. 4, one of the opposed members is affixed to the underside of buttress 8, and the other opposed member is affixed to the stop 9, positioned such that upon collapsing the present device to the closed position, the opposed members come into overlaying contact.

Figure 8:
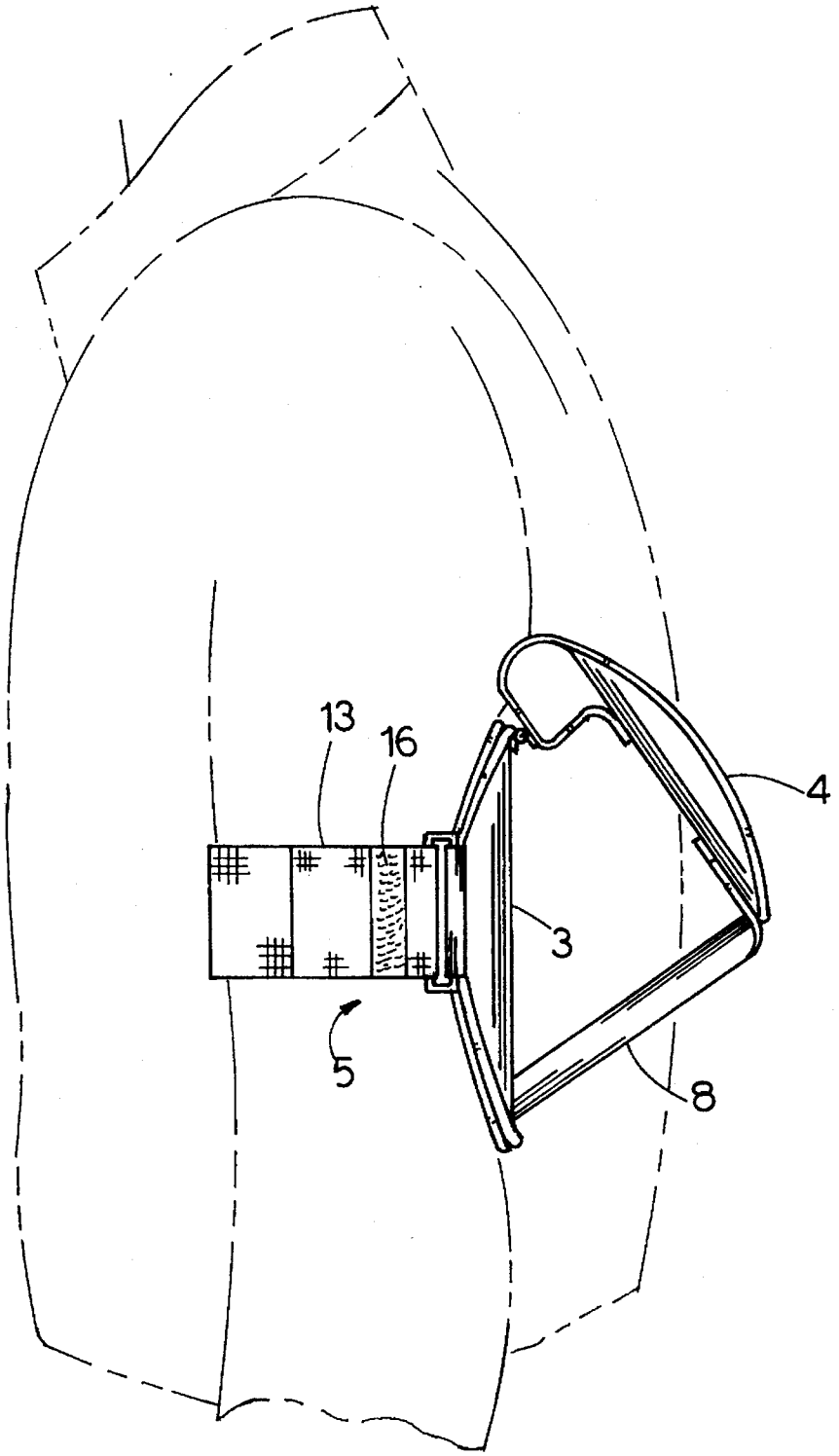
FIG. 8 is an environmental view of the invention as positioned when an arm of a user is at rest.

The wedge element of the present support member is engaged to a user's upper arm through retention element 5. Together with first section 3 the retention element encircles the user's arm, holding the support member against the humerus. The retention element may be a continuous arm band which secured to an undersurface of the first section 3. Preferably, as shown in FIG. 4, the retention element includes a ring be securing one end of arm band 13 to one side of first section 3. A buckle composed of another ring 19 and a friction bar, 20. The arm band may accordingly be adjusted to accommodate various arm circumferences. Optionally, the free end of the arm band may be provided with one or more hook and loop fasteners to help secure the arm band and/or to avoid excess material from trailing loosely about the arm, as shown in FIG. 8.

The wedge element of the present support member may be made of any suitable lightweight, substantially rigid material, such as plastic, aluminum, composites, and alloys. Liners 12, as shown in FIG. 4, may be provided on one or both surfaces with resilient pads of foam, rubber, or the like.

The arm band 13 of the retention element 5 may be made of any suitable fabric, including natural and synthetic weaves or knits of cotton, nylon, polyester, rayon, wool, and the like. Preferably, elastic fabrics, such as used in wrap bandages, are used.

Figure 6:
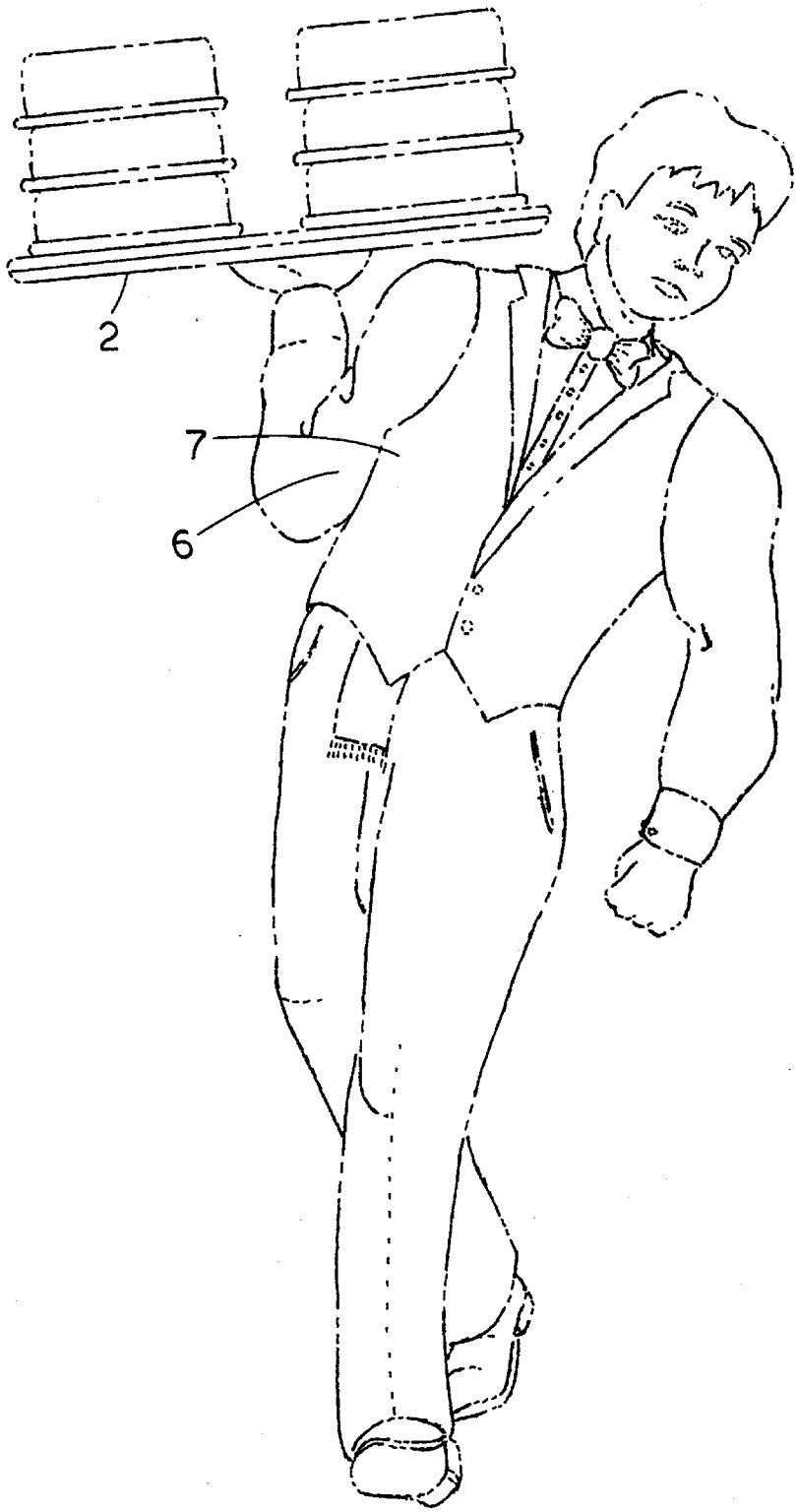
FIG. 6 shows an individual carrying a loaded tray without the aid of the present invention.

The advantages of using the support member of the present invention is illustrated in FIGS. 5–8. The conventional method for carrying a tray or like heavy object at shoulder level is illustrated in FIG. 6. Note that the body of the carrier is arched so that the humerus area 6 may be supported by the lateral portion of the thorax 7. This posture may lead to various chronic spinal and back injuries. Under the same load conditions, a carrier using the present invention maintains an upright posture, significantly reducing the risk of such injury.

The transfer and distribution of forces from the downward force from the load to the horizontal force upon the carrier's thorax is more efficient when using the present invention, reducing the actual load felt by the shoulder. Accordingly, stresses and injuries to the arm and shoulder are also reduced.

Figure 7:
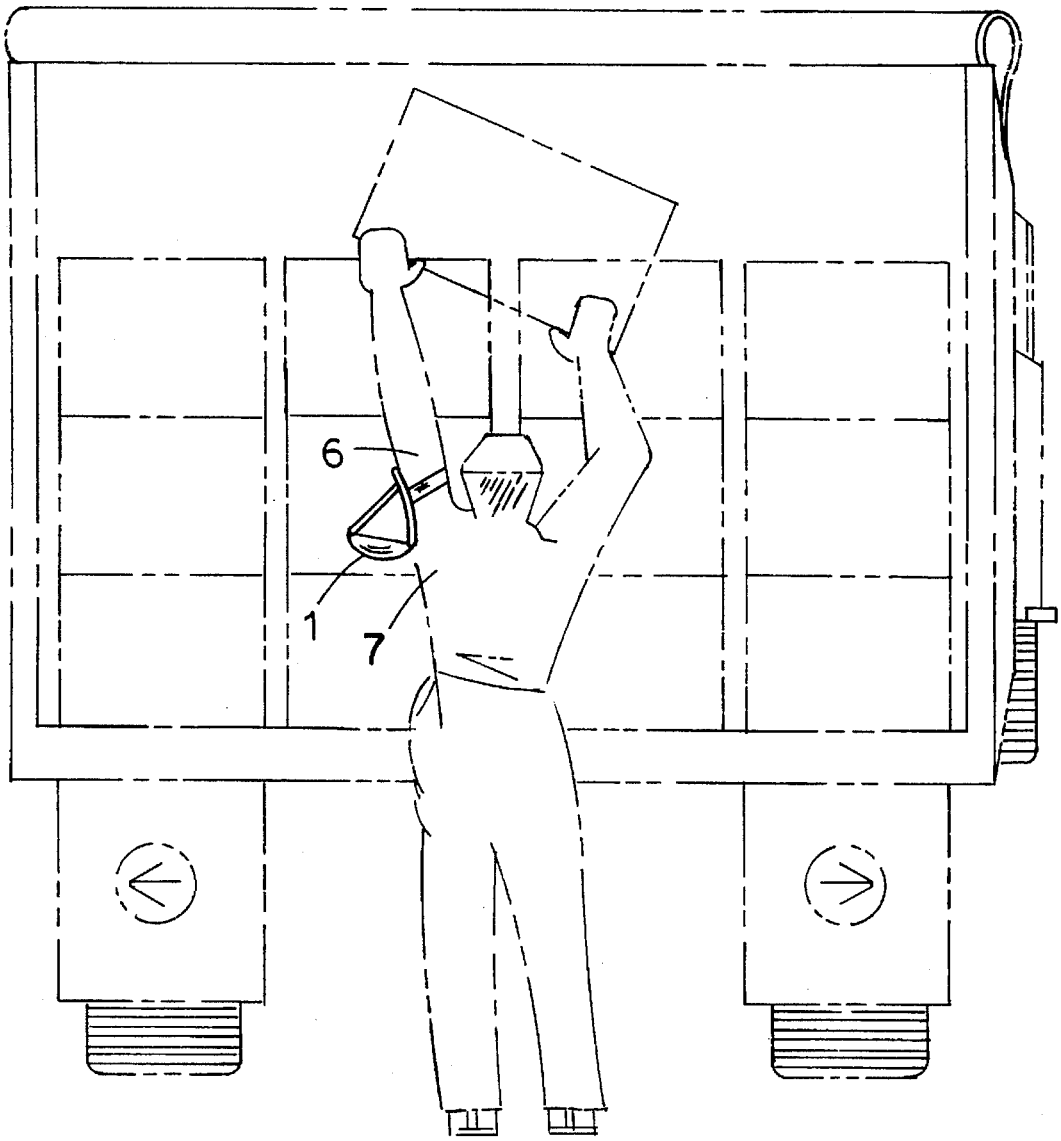
FIG. 7 is another environmental view showing a user removing a box from the rear of a truck, unhindered by the present invention.

Unlike devices of the prior art which restrict the arm to give various degrees of support, the present embodiments all allow the user a much greater range of arm movement. Thus the support member is not a restrainer of the medical variety, for example. As shown in FIG. 7, a user may unrestrictingly outstretch arms to receive a load to be subsequently carried and/or deliver the same. As shown in FIG. 8, the present support member rotates with the arm, positioning itself behind the user, when the arm is at rest.

It is to be understood that the present invention is not limited to the embodiments described above, but encompasses any and all embodiments within the scope of the following claims.

I claim:

1. A support member facilitating the carrying of a tray or the like over a user's shoulder comprising:

a wedge element having adjacent first and second sections each provided with a body-engaging outer surface, said first and second sections defining an acute angle therebetween; and a retention element engageable with said first section of said wedge element and the humerus area of a user's upper arm to maintain said outer surface of said first section juxtaposed upon the humerus area of the user's upper arm while said second section is free to move away from a user's thorax, thereby allowing arcuate displacement of said upper arm, whereby with said wedge element disposed intermediate a user's upper arm and lateral part of the user's thorax such that said first section is secured to said humerus area of said upper arm, and said second sections is pressed against said thorax, the user's upper arm is firmly supported by said wedge element and maintained in an outward oblique disposition such that the user's forearm may in turn be maintained in a substantially upward direction to facilitate carrying of items over the user's shoulder as downward forces applied to the user's arm are laterally vectored to the user's thorax by said wedge member.

2. The support member according to claim 1, wherein said wedge element further includes a horizontal buttress between said first and said second sections.

3. The support member according to claim 2, wherein said wedge element is substantially rigid.

4. The support member according to claim 2, including means for hingedly attaching said first section to said second section, said buttress is hingedly attached to one of said first section and said second section, and the other of said first and said second section includes a stop, whereby said support member may be collapsed when not in use.

5. The support member according to claim 4, wherein said buttress is hingedly attached to said first section, and said second section includes a stop.

6. The support member according to claim 1 wherein said body-engaging outer surface of each of said first and second sections is body contoured.

7. A support member facilitating the carrying of a tray or the like over a user's shoulder consisting essentially of:

a first section having a concave body contoured humerus engaging outer surface and a convex inner surface;

a second section having a concave body contoured thorax engaging outer surface inwardly bent at one end to form a curled end, a convex inner surface, a raised stop disposed towards an end of said inner surface distal said curled end, wherein said curled end of said second section is hingedly attached to one end of said inner surface of said first section, defining an acute angle therebetween;

a buttress hingedly attached to said inner surface of said first section distal said second section, said buttress having a length sufficient to bridge said first section to said stop of said second section such that said first section, said second section, and said buttress form a substantially rigid wedge when said buttress is locked by said stop of said second section; and a retention element engageable with said first section and the humerus area of a user's upper arm to maintain said outer surface of said first section juxtaposed upon the humerus area of the user's upper arm through arcuate displacement of said upper arm.

* * * * *